United States Patent [19]

Halverson

[11] 4,193,348

[45] Mar. 18, 1980

[54] PROJECTILE FOR CENTERFIRE PISTOL AND REVOLVER CARTRIDGES

[75] Inventor: Henry J. Halverson, Collinsville, Ill.

[73] Assignee: Olin Corporation, New Haven, Conn.

[21] Appl. No.: 877,939

[22] Filed: Feb. 15, 1978

[51] Int. Cl.[2] ..... F42B 11/10

[52] U.S. Cl. ..... 102/91; 102/92.2

[58] Field of Search ..... 102/38 R, 52, 91, 92.2

[56] References Cited

U.S. PATENT DOCUMENTS

| | | | |
|---|---|---|---|
| 376,302 | 1/1888 | Gregg | 102/91 |
| 437,262 | 9/1890 | Thomas | 102/92.2 |
| 1,080,974 | 12/1913 | Johnson | 102/91 |
| 1,502,925 | 7/1924 | Stone | 102/52 |
| 1,633,168 | 6/1927 | Dickerman | 102/91 |
| 1,681,295 | 8/1928 | Johnson | 102/91 |
| 1,715,788 | 6/1929 | Rousseau | 102/91 |
| 1,730,871 | 10/1929 | Aronson | 102/91 |
| 1,892,759 | 1/1933 | Woodford | 102/92.2 |
| 3,349,711 | 10/1967 | Darigo et al. | 102/91 |
| 3,881,421 | 5/1975 | Burczynski | 102/92.2 |

*Primary Examiner*—Charles T. Jordan

*Attorney, Agent, or Firm*—William W. Jones; Paul J. Lerner

[57] ABSTRACT

A projectile for a centerfire cartridge achieves maximum energy transfer with limited target penetration. A hollow point lead bullet is provided with an aluminum jacket which allows the cartridge containing the projectile to feed reliably in auto-loading pistols and yet does not restrict normal expansion of the bullet upon impact with the target. The jacket extends into the nose recess of the bullet and covers the peripheral portion of the bullet base, whereby the jacket is securely fastened to the bullet and separation subsequent to impact is prevented.

A method of fabricating the projectile is also disclosed.

10 Claims, 5 Drawing Figures

PROJECTILE FOR CENTERFIRE PISTOL AND REVOLVER CARTRIDGES

BACKGROUND

The present invention relates to small arms ammunition and, more particularly, to a hollow-point projectile for an auto-loading pistol.

Recently, several law enforcement agencies, including the Law Enforcement Assistance Administration (L.E.A.A.) have developed criteria for the selection of handgun ammunition for use by law enforcement officers. In general, the criteria are: maximum muzzle energy, optimum penetration, minimum weight loss or fragmentation upon upset, and acceptable pressure loading, accuracy and reliability.

Optimum penetration is defined as six inches or less in tissue simulating gelatin. This limitation was adopted to protect bystanders who might otherwise be injured by a projectile passing through the intended target and further serves to insure that all the projectile energy is transferred to the target. High rates of energy transfer, coupled with a high muzzle energy, are desirable to instantaneously disable the target, thereby preventing return fire on the law officers and eliminating the need for further fire on the target.

High energy transfer, coupled with controlled or limited projectile penetration, is conventionally achieved by use of a "hollow point" configuration wherein a centrally disposed axially directed recess is provided in the projectile nose. Such a recess weakens the projectile nose such that, upon impact, the projectile "mushrooms", opening outwardly and backwardly, thereby presenting a greatly increased frontal area.

Reliability is measured in terms of functioning in an auto-loading pistol, a type of weapon being adopted by an increasing number of law enforcement agencies for increased fire power and ease of operation.

To insure proper feeding, and prevent "jamming", the projectiles, generally formed of lead or a soft lead alloy, must resist deformation, especially deformation of the projectile nose, prior to firing. Deformation resistance is presently achieved through the provision of a protective covering or jacket, generally of brass or, less frequently, steel.

Unfortunately, the jackets of presently available fully jacketed auto-loading ammunition, while preventing deformation prior to firing, also prevent the desired mushrooming upon impact. This may result in the projectile passing completely through the target without achieving the desired instantaneous disablement. A bystander may then be injured by the projectile, either by being in the path of the bullet as it exits the initial target, or by a ricochet off a hard object such as a building or automobile.

Attempts at promoting mushrooming of a jacketed, hollow point projectile have generally involved scoring, slitting or otherwise weakening the jacket in the area of the projectile nose. Projectiles of this type are not entirely satisfactory since the degree of expansion and depth of penetration area highly dependent on the projectile's velocity at the point of impact and with the uniformity among projectiles of the device used to weaken the jacket material. Therefore, under unfavorable conditions, the hollow point projectile may not expand, thereby allowing it to pass through the target or, in the other extreme, to fragment into several pieces causing massive and undue destruction of tissue. The gravity of the tissue destruction problem is increased by the fact that the jacket fragments, generally being brass, do not provide a clear X-ray image as does the lead portion of the projectile.

SUMMARY OF THE INVENTION

The present invention is a projectile designed especially, but not exclusively, for an auto-loading pistol which provides maximum energy transfer with optimum target penetration. This is accomplished, in general, by combining a hollow-point bullet and a jacket having suitable hardness and strength characteristics. More particularly, I have discovered that a jacket formed of a metal having a hardness of between about 45 and about 60 as measured by the Rockwell R-15T Hardness Test and a shear strength of between about 12,000 and about 24,000 p.s.i. will provide the necessary deformation protection to assure reliable feeding in an auto-loading weapon while not preventing expansion or mushrooming of the projectile upon impact.

One material, meeting the aforementioned criteria, which may be advantageously employed in the practice of the present invention is aluminum.

As regards jacket material, my invention is directly contradictory of the current opinion, widely held by those skilled in the art of ammunition design, and based upon experiments dating back to the early post World War II years, that metals having these characteristics and, in particular, aluminum or aluminum alloys are not suitable materials for projectile jackets as they result in rapid fouling of the weapon bore. This opinion is an extrapolation of data gathered from work on applications involving aluminum jacketed projectiles and relatively high muzzle velocities, i.e., in excess of 1400 f.p.s.

Upon careful analysis, I have determined that barrel fouling with aluminum jacketed projectiles is a function of projectile velocity and that such fouling becomes a significant factor only at muzzle velocities in excess of about 1200 f.p.s. Thus, these materials are suitable for use in pistol projectiles which typically attain muzzle velocities in the range of 800–1200 f.p.s.

It is a further aspect of the invention that the jacket overlaps a peripheral portion of the bullet base and enters into the recess in the bullet nose, whereby the jacket is securely attached to the bullet. I have discovered that the presence of a jacket on the re-entrant surface of the recess momentarily retards mushrooming which otherwise would result in excessive energy deposition on the target surface. This feature also reduces the possibility of separation of the jacket from the bullet subsequent to impact, as the jacket now becomes crimped into the bullet material as the bullet expands and folds back upon itself. Further, by avoiding notches, slits or other jacket-weakening devices, a more uniform projectile is provided having more consistent upset performance and less velocity dependence.

The projectile described above may be advantageously fabricated by a novel method wherein a bullet blank and cup-shaped jacket blank are swaged together and the cup base and underlying bullet are then pierced so as to form the bullet recess, a portion of the jacket being driven into the recess during the piercing.

BRIEF DESCRIPTION OF THE DRAWING

The various objects and advantages of the invention will be more clearly understood through reference to the following detailed description and the accompanying drawing wherein.

DESCRIPTION OF THE PREFERRED EMBODIMENT

Figure 1:
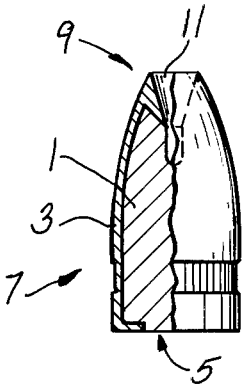
FIG. 1 is a side elevational view, partly in cross-section, of one embodiment of the projectile of the present invention.

As seen in FIG. 1, the projectile of the present invention comprises a soft metal bullet 1, preferably formed of lead or a lead alloy, and a metal jacket 3.

The bullet 1 includes a substantially planar base 5, a cylindrical body 7, and a frusto-conical nose 9 having a centrally disposed, axially aligned recess 11. Bullets of this general type are commonly known by the generic designation "hollow point".

The jacket 3, of substantially uniform thickness, overlies the body 7 and extends over the peripheral portion of the base 5 and into the recess 11 of the bullet 1.

Jacket material is chosen from the group of metals having a hardness of between about 45 and about 60 and a shear strength of between 12,000 and 24,000 p.s.i. These values are characteristic of most aluminum (except annealed 1100 aluminum) and of zinc alloys.

As indicated by the following table, comparison of the projectiles of the present invention with commercially available projectiles reveals marked superiority in penetration, energy deposition and reliability.

Cal. 380 COMPARATIVE EVALUATION

| | Velocity Into Gelatin (fps) | Velocity Out of Gelatin (fps) (6" block) | Energy Deposited As % of Total Available | Functioning |
|---|---|---|---|---|
| 100 Gr. Aluminum Jacketed Hollow Point | 943<br>915<br>899 | 0<br>0<br>0 | 100<br>100<br>100 | 10 clips total fired in 3 pistols result: all fed |
| 95 Gr. Full Metal Jacketed (brass) | 966<br>938<br>928 | 703<br>692<br>663 | 47<br>46<br>48 | 4 clips total fired in 2 pistols result: 1 rd. failed to feed |
| 90 Gr. Jacketed Hollow Point (brass) | 946<br>920<br>939 | 534<br>565<br>455 | 68<br>62<br>77 | 4 clips total fired in 2 pistols result: 1 rd. failed to feed |
| 100 Gr. Jacketed Hollow Point (brass) | 877<br>928<br>905 | 289<br>167<br>296 | 89<br>97<br>90 | 4 clips total fired in 2 pistols result: 2 rds. failed to feed |

In a further test, five 115 grain, cal. 9mm projectiles were fired, with a muzzle velocity of 1125 f.p.s., into gelatin blocks. None of the projectiles penetrated beyond five inches and no individual projectile had a weight loss exceeding three grains. In this regard, it is significant to note that the L.E.A.A. criteria for weight loss if 5% of projectile weight of nearly twice the rate demonstrated by the present invention.

This test demonstrates the efficacy of the novel jacket configuration in preventing separation of the jacket from the bullet. By means of an overlapped base portion and a reentrant nose portion, the jacket is securely attached to the bullet.

Further, the presence of a jacket having the metallurigical characteristics previously described, on the reentrant surface of the bullet recess, momentarily retards expansion. In the absence of such a reentrant jacket, an unacceptably high portion of the projectile energy is deposited within two inches of the target surface.

In FIGS. 2–5, there is shown a series of steps for fabricating a projectile in accord with the present invention.

Figure 2:
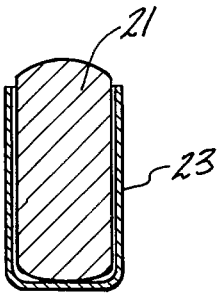
FIGS. 2–5 are diametrical cross-sectional views illustrating the steps of a method of fabricating the projectile of FIG. 1.

In FIG. 2, there is shown a bullet blank or core 21 disposed within a jacket blank or cup 23.

Figure 3:
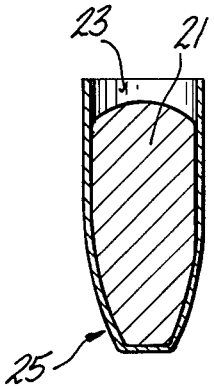
Figure 4:
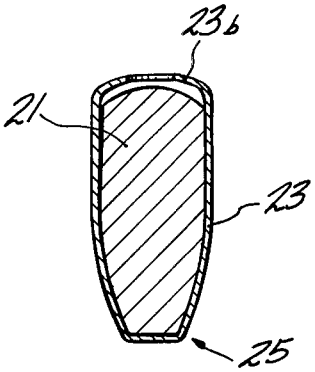

In FIGS. 3 and 4, the core 21 and cup 23 have been swaged together, by means well known in the art, so as to form a frusto-conical nose 25 in the closed end of the cup 23 and in the underlying portion of the core 21, while the distal end portion 23*b* of the cup 23 has been folded inwardly over the core 21.

Figure 5:
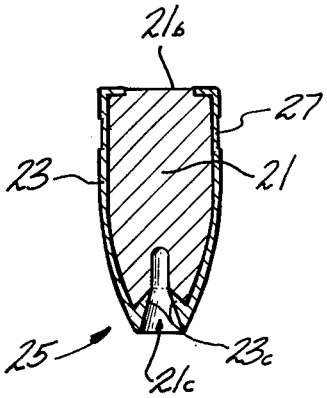

A final swaging operation produces the finished projectile as seen in FIG. 5. The distal portion 23*b* of the cup 23 has been brought into position overlying the peripheral edge of the now planar base 21*b* of the core 21, while the nose 25 has been pierced to form the recess 21*c*. During the piercing operation, a portion 23*c* of the cup 23 is driven into the recess 21c. Formation of this re-entrant portion 23*c* is made possible by the peculiar physical properties of the material of the jacket blank 23.

If desired, an annular knurled band 27 may be formed in the jacket, rearward of the midpoint of the projectile, and filled with a suitable lubricating material, thereby increasing the maximum muzzle velocity at which the projectile of the present invention may be advantageously employed and reducing the possibility of barrel fouling when the projectile is fired at velocities approaching 1200 f.p.s.

While the specific details of my invention have been shown and described herein, the invention is not confined thereto as various changes and alterations can be made without departing from the spirit thereof as defined in the appended claims.

What is claimed is:

1. A projectile for small arms consisting of a soft metal bullet and a jacket at least partially enclosing said bullet, said jacket being formed of a metal having a hardness of between about 45 and about 60 as measured by the Rockwell R-15T Hardness Test and a shear strength of between about 12,000 and about 24,000 p.s.i.

2. The projectile of claim 1, wherein said bullet includes a nose portion having a centrally disposed, axially aligned recess, and said jacket includes a reentrant portion within said recess.

3. The projectile of claim 2, wherein said bullet has a substantially planar base, and a portion of said jacket overlaps the periphery of said base.

4. The projectile of claim 1, wherein said jacket is substantially aluminum.

5. The projectile of claim 3, further comprising an annular knurled band formed in said jacket and adapted to receive a lubricating material.

6. A hollow-point projectile for an auto-loading pistol consisting of a soft metal bullet and a jacket enclosing said bullet; said bullet including a pointed nose portion and a planar base, said nose portion having a centrally disposed, axially aligned recess, said jacket overlapping a peripheral portion of said base and entering into said recess, at least the nose portion of said jacket being perforated whereby at least the base of said recess is exposed, whereby said jacket is securely attached to said bullet and mushrooming of said bullet is controlled.

7. The projectile of claim 6, wherein said jacket is formed of a metal having a hardness of between about 45 and about 60 as measured by the Rockwell R-15T Hardness Test and a shear strength of between about 12,000 and about 24,000 p.s.i.

8. A controlled penetration projectile consisting of a high-density, soft metal bullet having a nose portion including a centrally disposed axially aligned recess, and a jacket enclosing said bullet; said jacket completely covering said nose portion to protect the same from deformation prior to firing and entering into said recess to securely fasten said jacket to said bullet, at least the nose portion of said jacket being perforated whereby at least the base of said recess is exposed, said jacket being adapted to permit ready expansion of said nose portion upon impact with a tissue-like target whereby penetration of the projectile is limited.

9. A method of fabricating a fully-jacketed hollow-point projectile for small arms comprising the steps of:

(a) providing a metal core disposed within a metal cup;

(b) swaging said core and said cup together so as to form a nose in the closed end of said cup and in the underlying portion of said core; and (c) piercing through said nose of said cup and into said core, thereby forming a recess in said core, a portion of said cup being driven into said recess during said piercing.

10. The method of claim 9 and the additional step of folding the distal end portion of said cup to overlie the peripheral portion of the end of said core opposite said nose.

* * * * *